United States Patent [19]

Crowe

[11] 3,990,759

[45] Nov. 9, 1976

[54] INSULATORS

[75] Inventor: Terence Alfred Crowe, Johannesburg, South Africa

[73] Assignee: Joseph Graham Spargo, Johannesburg, South Africa

[22] Filed: May 19, 1975

[21] Appl. No.: 578,891

[30] Foreign Application Priority Data

May 17, 1974 South Africa ..... 74/3170

[52] U.S. Cl. ..... 339/59 R

[51] Int. Cl.[2] ..... H01R 13/40

[58] Field of Search ..... 339/59–61, 339/217, 256 SP, 258 S

[56] References Cited

UNITED STATES PATENTS

| | | | |
|---|---|---|---|
| 3,441,661 | 4/1969 | Brummans | 339/217 S |
| 3,582,863 | 6/1971 | Hoffman | 339/59 M |
| 3,641,477 | 2/1972 | Plana | 339/59 R |
| 3,680,035 | 7/1972 | Teagno et al. | 339/59 M |
| 3,693,134 | 9/1972 | Trevisiol | 339/59 M |

*Primary Examiner*—Joseph H. McGlynn

*Attorney, Agent, or Firm*—Young & Thompson

[57] ABSTRACT

This invention relates to an insulator for electrical terminals known as 'fast on' or 'quick connect' terminals. The insulator consists of a housing made from a rigid plastic material and includes, a terminal receiving passage which passes through the housing, a stop in the passage and a catch made integral with one wall of the housing and movable between a first position in which it is clear of the passage and a second position in which it is held in the passage to trap a terminal between it and the stop.

6 Claims, 7 Drawing Figures

INSULATORS

Figure 1:
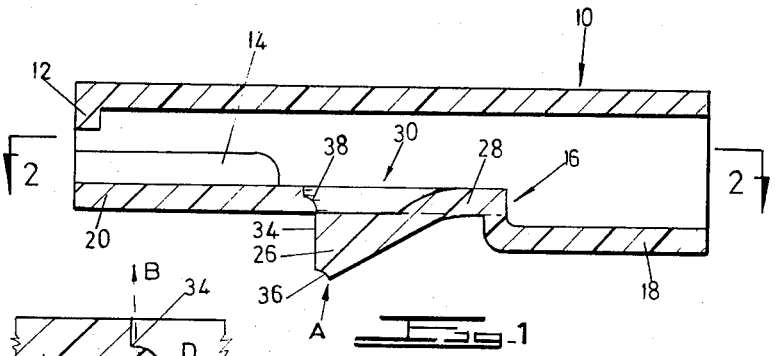

This invention relates to an insulator for electrical terminals of the type commonly known as 'fast on' or 'quick connect' terminals.

Insulation of terminals of the above type is conventionally achieved by locating the terminal in a housing made of electrically insulating material. The housings may be made to receive single or multiple terminals, their shapes vary and the means by which the terminal is retained or located in the insulator housing varies from one type of terminal to the other.

The retaining means in one form of insulator which is made from a soft thermo plastic material, consist of projections which extent into the body or passage of the housing and frictionally engage the terminal or terminals when placed in the housing.

In another form of insulator the housing includes substantially rigid inwardly projecting formations which are engaged by a resilient lance formed on the terminal.

In yet another form of insulator, which is made from a resilient plastic material, the housing includes a flap which is formed by two longitudinal slits and a rearwardly angled transverse slit. The terminal is held in this housing by pressing the flap through the wall of the housing to form a projection which abuts the rear of the terminal to trap it in the housing.

Still another form of insulator consists of a sleeve which is placed over the terminal and then shrunk by heat and pressure to conform to the shape of the terminal.

The problems associated with insulators of the above type are one or more of the following.

It is generally necessary to preposition the insulator on the conductor to which a terminal is to be attached prior to the attachment of the terminal. Once the terminal is attached to the conductor the insulator is pulled over the terminal in a second step of assembly. This mode of assembly places a severe limitation on the rate at which harnesses or looms utilising the above terminals can be manufactured. In all of the insulators mentioned above it is necessary that there be close conformity between the internal shape of the housing and the external shape of the terminal and because of this the insulators are dimensionally specific to the terminals for which they are designed. As the width of the terminals is standardised but their height varies considerably from manufacturer to manufacturer it is not possible to use a single insulator on all terminals. Also, because of the resilience of the material used in the manufacture of known terminals the engagement between the insulator and terminal is tenuous and the insulators are often pulled from the terminals.

In the third type of insulator described above the slits cannot be formed during the moulding process and a special production stage is necessary for this purpose making the insulators uncompetitively expensive.

It is the object of this invention to provide an insulator in which the above problems are at least minimised.

According to the invention an insulator for an electrical terminal comprises a housing made from a plastic material including a passage for the terminal, a stop in the passage, a catch integral with and hinged to one wall of the passage and movable between a first position in which it is clear of the passage and a second position in which a portion of the catch is located in the passage to trap the terminal between it and the stop, and means to hold the catch in its second position; the insulator having the improvement that, the material from which the housing is made is rigid, a portion of the catch in its first position projects from the outer surface of the wall by an amount equal to at least twice the wall thickness and that the wall of the housing at the hinge of the catch is stepped outwardly from the passage.

Figure 3:
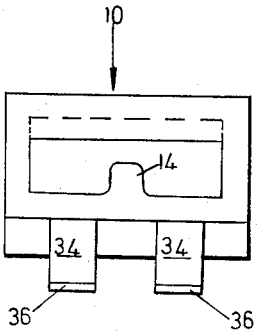
Figure 4:
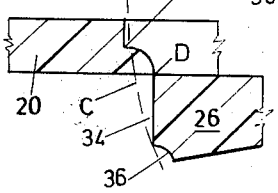
Figure 2:
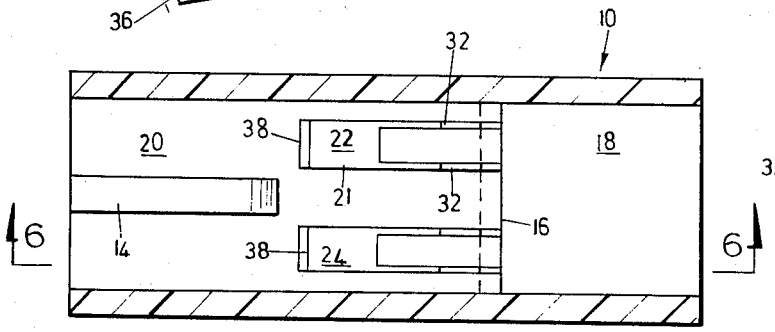
Figure 5:
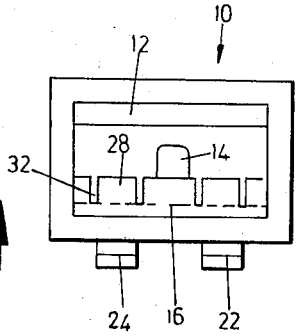
Figure 6:
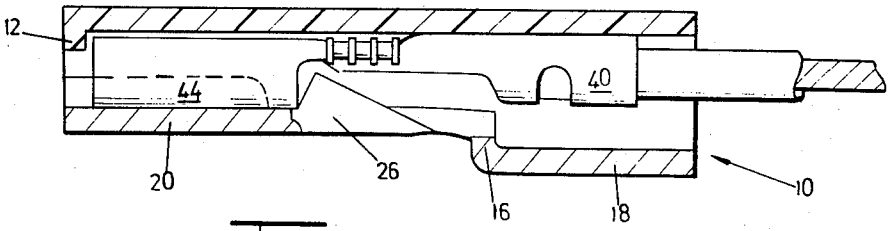
Figure 7:
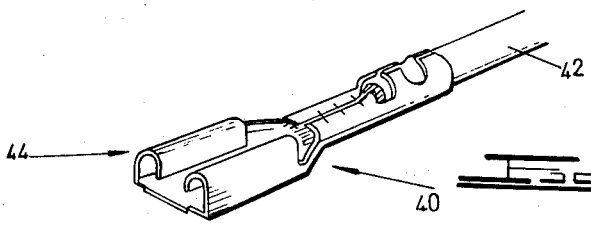

An embodiment of the invention is now described by way of example with reference to the drawings in which FIG. 1 is a sectional side elevation of an insulator of the invention, FIG. 2 is a plan view of the insulator sectioned on the line 2—2 in FIG. 1, FIG. 3 is an end elevation of FIG. 1, FIG. 4 is an enlarged fragmentary view of FIG. 1, FIG. 5 is the insulator seen from the end opposite to that shown in FIG. 3, and FIG. 6 is a side elevation of the insulator sectioned on the line 6—6 in FIG. 2 with a terminal of the type shown in FIG. 7 locked in the insulator.

FIG. 7 shows a terminal used in the insulator of the invention.

The drawings show the insulator of the invention to consist of a housing 10 which is made by a conventional moulding process, such as injection moulding from a rigid plastic material and includes a passage which is substantially rectangular in cross section and extends from one end of the housing to the other.

The term rigid in this specification is taken to mean plastic materials which have a sufficiently high modulus of elasticity to make them substantially non resilient and/or flexible. Suitable materials are: polyacetal, polycarbonate, polyamide synthetic resins and the like.

A stop 12 is located across the passage at one end of the housing to form an abutment for the forward end of a terminal.

A centrally located rib 14 projects from the lower wall of the housing, as seen in the drawings, and serves to locate the forward end of a terminal placed in the passage against transverse movement.

The lower wall of the housing is stepped normally at 16 to divide the wall into two floors 18 and 20.

The insulator includes two catches 22 and 24 which are located in the floor 20 behind the rib 14. The catches consist of a substantially triangular portion 26 and a rib 28 which is attached to the housing in the step 16. The triangular portion of each catch projects from the outer surface of the floor 20 by an amount equal to at least twice the thickness of the floor but less than the width of the narrow portion of the passage through the housing including the thickness of the floor 20.

The wall 20 immediately under the triangular portion of each catch is recessed as indicated generally by the numeral 30 in FIG. 1. The recess is as deep as the thickness of the wall 20 and as wide as the width of the triangular portion of each catch. A slot 32, having a depth equal to the thickness of the floor 20, extends from the recess through the step 16 on each side of the rib 28 of each catch. The coincidence of the edges of the base of both the recess and triangular portion of each catch together with the slots 32 frees the catch from the material of the wall 20 making a cutting step as an operation subsequent to moulding unnecessary and results in the catch being connected to the step by means of the rib 28 only.

As is seen in FIG. 1 the leading edge 34 of each catch is normal to the general plane of the floor 20 and includes at its outer end, a semicircular recess 36. A detent 38, which is complimentally shaped to the recess 36 is located along the forward edge of the recess 30.

As mentioned above the insulator is designed to accommodate a 'fast on' or 'quick connect' type of terminal, one of which is illustrated in FIG. 7.

The drawing shows the underside of the terminal which is seen to include a portion 40 in which a conductor 42 is crimped, and a socket portion indicated generally at 44. The longitudinal edges of the socket portion are provided with rounded grippers which are shaped to form between them a channel.

In use, the terminal with its cable attached, is slid into the insulator, as seen in FIG. 6, until its forward end abuts the stop 12. The rib 14 is, in this position, located in the channel between the grippers of the terminal and as mentioned above serves to centralise the terminal in the housing 10. The rear end of the socket portion 44 of the terminal lies forward of the leading edge 34 of the catches 22 and 24, as is seen in FIG. 6.

The catches are now pressed in the direction of the arrow A in FIG. 1. Because the distance between the rear face of the step 16 and the recess 36 is greater than the distance between the step and the detent 38, the end of the catch where the recess 36 is located will tend to move on the arc B shown in FIG. 4. The catch, in moving through the arc, will experience a compressive interference equal to the distance separating C and D in the drawing causing a slight deflection of the wall at point 16 to provide a hinging effect. The compressive stress over that length of the catch is partially relieved when the detent 38 is engaged in the recess 36 as seen in FIG. 6 and the remaining stress in the catch becomes tensile positively to lock the catch in the position shown.

With the catches in the position shown in FIG. 6 the terminal is positively trapped against withdrawal from the insulator by the stop 12 and the edges 34 of the catches. Because of the degree of penetration of the catch into the passage of the insulator and the rigidity of the material from which the insulator is made there is little or no possibility of the insulator being accidentally stripped from the terminal. The catches may, however, easily be released from the position shown in FIG. 6 by pressing the catches back through the recesses from the inside of the housing to the position shown in FIG. 1 by means of any suitable flat bladed tool.

Because the catches are formed on the outside of the passage the entry of a terminal into the passage is unrestricted and as is appreciated from FIG. 6 the insulator is capable of positively retaining any terminal the height of the socket portion of which is greater than the distance separating the upstanding point of the catch and the opposite wall of the passage. As mentioned above this distance is dependent only on the distance by which the catch is made to project from the outer surface of the wall 20 and is therefore not limited to that shown in the drawing..The catch could for example be made large enough to trap substantially flat terminals of the 'tab' type.

The purpose of providing the step 16 between the floors 18 and 20 is not only to provide a point of hinge contact between the ribs 28 on the catches and the housing but is essential to the moulding operation by means of which the insulator is made in that the recess 30 is an undercut which would restrict the removal of the housing from the core part of the mould, particularly if the insulator is moulded from a rigid material. The step minimises the effect of the undercuts in the removal operation and provides a terminal point for the slots 32 which would otherwise be practically impossible to produce in a single moulding operation.

The invention is not limited to the precise constructional details as herein described and the catch could for example include a formation adapted to engage a complimentally shaped formation on a terminal of the type other than those mentioned above. Additionally, the insulator could include a plurality of terminal receiving passageways including catches so that a number of terminals could be located in a single insulator.

I claim:

1. An insulator for an electrical terminal, comprising a housing made from a plastic material including two opposed pairs of walls which define between them a continuous elongated passage which passes through the housing, a stop adjacent one end of the passage adapted to arrest movement of a terminal through the housing, an outward step in one wall of the passage, a catch integral with and hinged at one end to the step in the stepped wall of the passage, a face on the catch remote from the catch hinge, said face having a length at least twice the thickness of the wall to which the catch is attached; the catch being movable on said hinge between a first position on the outside of the housing and in which said face is substantially normal to the outer surface of said wall to which it is attached and clear of the passage and a second position in which it has passed through an opening in the wall and in which a portion of the catch is located in the passage to trap a terminal in the passage between the catch and the stop, and a formation on the catch adapted to engage a formation adjacent the edge of the opening through which the catch is movable to hold the catch in said second position.

2. An insulator as claimed in claim 1 in which the opening in the wall through which the catch passes in movement from said first to second positions extends from the end of the catch which is opposite said one end to a position short of the step in the wall and the outer edges of the opening are coincident with the lower edges of the catch when the catch is in said first position.

3. An insulator as claimed in claim 2 in which a slot which is as deep as the thickness of the wall extends from each side of the opening on either side of the catch into the step so that the hinge of the catch is in the step in the wall.

4. An insulator as claimed in claim 3 including two catches which are arranged side by side in the stepped wall.

5. An insulator as claimed in claim 4 in which a guide projects from one wall of the housing into the passage to engage and transversely to locate a terminal located in the passage.

6. An insulator as claimed in claim 5 in which the step in the wall is substantially normal to the outer surface of the wall.

* * * * *